US009792849B2

(12) United States Patent
Yao et al.

(10) Patent No.: US 9,792,849 B2
(45) Date of Patent: Oct. 17, 2017

(54) DISPLAY PANEL, DISPLAY DEVICE AND DISPLAY METHOD

(71) Applicants: XIAMEN TIANMA MICRO-ELECTRONICS CO., LTD., Xiamen (CN); TIANMA MICRO-ELECTRONICS CO., LTD., Shenzhen (CN)

(72) Inventors: Shulin Yao, Xiamen (CN); Zhaodong Zhang, Xiamen (CN); Poping Shen, Xiamen (CN); Ting Zhou, Xiamen (CN)

(73) Assignees: Xiamen Tianma Micro-Electronics Co., Ltd., Xiamen (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 14/966,176

(22) Filed: Dec. 11, 2015

(65) Prior Publication Data

US 2017/0061846 A1 Mar. 2, 2017

(30) Foreign Application Priority Data

Aug. 28, 2015 (CN) ..... 2015 1 0541342

(51) Int. Cl.
*G09G 3/20* (2006.01)
*G09G 3/36* (2006.01)

(52) U.S. Cl.
CPC ..... *G09G 3/2074* (2013.01); *G09G 3/2003* (2013.01); *G09G 3/3607* (2013.01);
(Continued)

(58) Field of Classification Search
CPC ... G09G 2300/0443; G09G 2300/0447; G09G 2300/0452; G09G 3/2074; G09G 3/3607; G02F 1/133609
See application file for complete search history.

(56) References Cited

U.S. PATENT DOCUMENTS 5,899,550 A * 5/1999 Masaki ..... G02F 1/133514 349/106
7,417,648 B2 * 8/2008 Credelle ..... G02F 1/133514 345/690

(Continued)

FOREIGN PATENT DOCUMENTS

CN 1726593 A 1/2006
CN 202041673 U 11/2011

(Continued)

*Primary Examiner* — Darlene M Ritchie
(74) *Attorney, Agent, or Firm* — Kilpatrick Townsend & Stockton LLP

(57) ABSTRACT

Provided is a display panel, a display device and a display method. The display panel includes at least a first sub pixel column to a third sub pixel column that are sequentially arranged. The first sub pixel column is formed of 2N first color sub pixels, wherein N is a positive integer; the second sub pixel column is formed of 2N second color sub pixels and is offset by a predetermined pitch in a column direction with respect to the first sub pixel column; and the third sub pixel column is formed of alternate N third color sub pixels and N white sub pixels. Each of the second color sub pixels together forms a pixel unit with its adjacent white sub pixel, third color sub pixel and two first color sub pixels, to perform display. The present disclosure may provide a better display effect.

14 Claims, 9 Drawing Sheets

(52) U.S. Cl.
CPC ..... *G09G 2300/0443* (2013.01); *G09G 2300/0447* (2013.01); *G09G 2300/0452* (2013.01); *G09G 2300/0465* (2013.01); *G09G 2330/021* (2013.01)

(56) References Cited

U.S. PATENT DOCUMENTS

2004/0046725 A1 3/2004 Lee
2004/0108818 A1* 6/2004 Cok ..... G09G 3/3216 315/169.3
2005/0151752 A1* 7/2005 Phan ..... G09G 3/2003 345/589
2008/0049048 A1* 2/2008 Credelle ..... G09G 3/2074 345/690
2009/0102769 A1* 4/2009 Kouno ..... G09G 3/3648 345/88
2009/0115952 A1* 5/2009 Nakamura ..... G02B 5/201 349/143
2012/0092238 A1* 4/2012 Hwang ..... G09G 3/20 345/55
2014/0226323 A1 8/2014 Huang et al.
2015/0061978 A1* 3/2015 Shih ..... G09G 3/3225 345/76
2015/0371605 A1* 12/2015 Wu ..... G09G 5/02 345/604
2016/0155396 A1* 6/2016 Yang ..... G09G 3/3648 345/87
2016/0155398 A1* 6/2016 Yang ..... G09G 3/3607 345/87
2016/0240593 A1* 8/2016 Gu ..... G09G 3/3225
2016/0266452 A1* 9/2016 Xu ..... G02F 1/133512
2016/0358536 A1* 12/2016 Li ..... G09G 3/20
2017/0025053 A1* 1/2017 Broughton ..... G09G 3/2074

FOREIGN PATENT DOCUMENTS

CN 103137023 A 6/2013
CN 103325315 A 9/2013
CN 103762224 A 4/2014
CN 103903549 A 7/2014
CN 103941487 A 7/2014
CN 103946915 A 7/2014
JP 2008122834 A 5/2008
KR 20050066578 A 6/2005

* cited by examiner

DISPLAY PANEL, DISPLAY DEVICE AND DISPLAY METHOD

This application is based upon and claims priority to Chinese Patent Application No. 201510541342.9, filed on Aug. 28, 2015, the entire contents of which are incorporated herein by reference.

TECHNICAL FIELD

The present disclosure relates to the technical field of display technology, particularly, to a display panel, a display device and a display method.

BACKGROUND

With the development of optical technology and semiconductor technology, flat display panels such as liquid crystal display (LCD) panels and organic light emitting diode (OLED) display panels have been widely applied in various electronic products for their characteristics of having a slimmer shape, a lower cost and power consumption, faster response speed, better color purity and brightness, higher contrast ratio, and the like.

FIG. 1 is a schematic diagram of a pixel matrix in a standard RGB display panel in the prior art. Herein, each sub pixel has an aspect ratio of 3:1. Adjacent red sub pixel, green sub pixel and blue sub pixel in the same row together constitute a pixel unit to display various colors.

Currently, as the continuously increasing of size and resolution of the display panel, power consumption becomes higher and higher, and it becomes a current major problem to effectively reduce the power consumption of the display panel. Compared with a conventional standard RGB (Red, Green and Blue) display panel, a standard WRGB (White, Red, Green and Blue) display panel may increase brightness of the display panel and meanwhile may effectively reduce power consumption of the display panel, and thus has been paid increasingly attention.

FIG. 2 is a schematic diagram of a pixel matrix in a conventional standard WRGB display panel. As can be seen, compared with the pixel matrix in a standard RGB display panel, white sub pixels are added along a row direction. Accordingly, in a display panel of the same size, the conventional standard WRGB display panel has the number of lines such as data lines increased by 1/3 over the standard RGB display panel. That is, wirings are increased in the display panel, which is disadvantageous to the increasing of the aperture ratio of the display panel. Meanwhile, pitches between pixels also become smaller, which increases process difficulty of the display panel and is disadvantageous to the yield rate of the product. In addition, with respect to a standard WRGB display panel having relatively lower pixels per inch (PPI), vertical bright bars may occur on the display panel since the white sub pixels are arranged in stripe shapes and have very high transmittance.

SUMMARY

The present disclosure is directed to providing a display panel, a display device and a display method, so as to overcome, at least to some extent, one or more problems due to restrictions and defects in the related art.

Other properties and advantages of the present disclosure will become more apparent from the flowing detailed description, or in part, may be learned from the practice of the present disclosure.

According to a first aspect of the present disclosure, provided is a display panel including at least a first sub pixel column to a third sub pixel column that are sequentially arranged, wherein:

the first sub pixel column is formed of 2N first color sub pixels, wherein N is a positive integer;

the second sub pixel column is formed of 2N second color sub pixels and is offset by a predetermined pitch in a column direction with respect to the first sub pixel column; and the third sub pixel column is formed of alternate N third color sub pixels and N white sub pixels, wherein each of the second color sub pixels together forms a pixel unit with its adjacent one white sub pixel, one third color sub pixel and two first color sub pixels, to perform display.

According to a second aspect of the present disclosure, provided is a display device including:

a display panel described above.

According to a third aspect of the present disclosure, provided is a display method applied in a display panel, the display panel including at least a first sub pixel column to a third sub pixel column that are sequentially arranged, wherein: the first sub pixel column is formed of 2N first color sub pixels, wherein N is a positive integer, the second sub pixel column is formed of 2N second color sub pixels and is offset by a predetermined pitch in a column direction with respect to the first sub pixel column; and the third sub pixel column is formed of alternate N third color sub pixels and N white sub pixels, wherein each of the second color sub pixels together forms a pixel unit with its adjacent one white sub pixel, one third color sub pixel and two first color sub pixels, to perform display. The method including:

according to a first sub pixel rendering algorithms, converting a brightness value of each sub pixel in a first virtual pixel array corresponding to an image to be displayed into a brightness value of each sub pixel in the pixel unit.

In the display panel, display device and display method in the exemplary embodiments of the present disclosure, by providing a new RGBW pixel matrix structure, on one hand, the transmittance of the display panel may be effectively increased, thereby reducing power consumption; meanwhile, white sub pixels are arranged in a dispersed manner, thereby bright bars may be prevented from occurring; and such a pixel matrix structure may uniformly distribute brightness of the pixel unit in each direction, thereby improving overall rendering effects and providing a better view angle. On the other hand, the pixel matrix, combining with a corresponding sub pixel rendering algorithm, may visually provide a PPI substantially close to a standard RGB display panel; meanwhile, compared with a typical standard RGBW pixel matrix, a number of sub pixels may be greatly reduced and correspondingly reducing the wirings such as data lines, an aperture ratio of the display device may be efficiently increased while reducing a cost and lowering process difficulty, thereby providing a better display effect.

BRIEF DESCRIPTION OF THE DRAWINGS

The above and other features and advantages of the present disclosure will become more apparent by describing its exemplary embodiments in detail with reference to the drawings.

DETAILED DESCRIPTION

Figure 1:
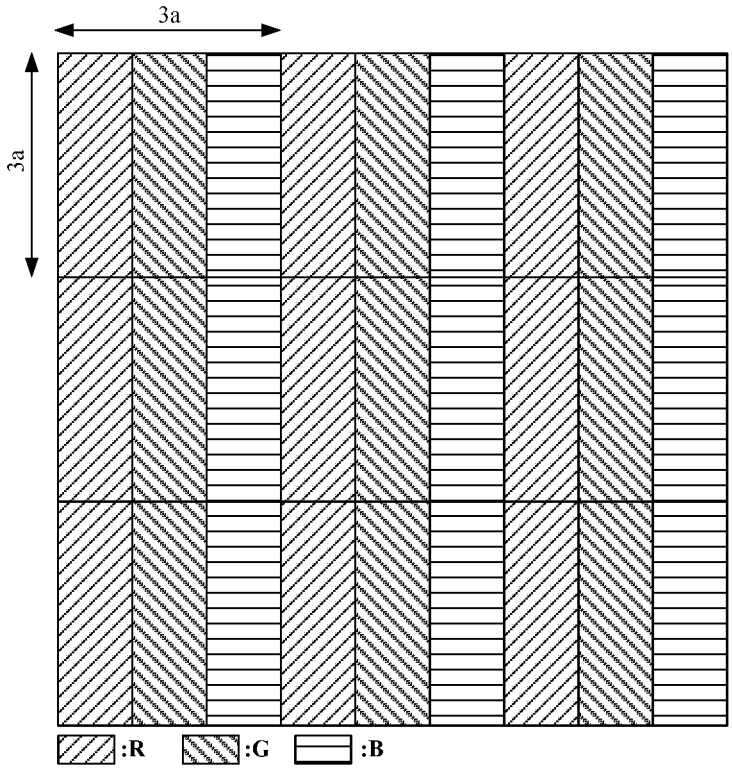
Fig. 1 (Prior Art)
FIG. 1 is a schematic diagram of a pixel matrix in a standard RGB display panel in the conventional art.
Figure 2:
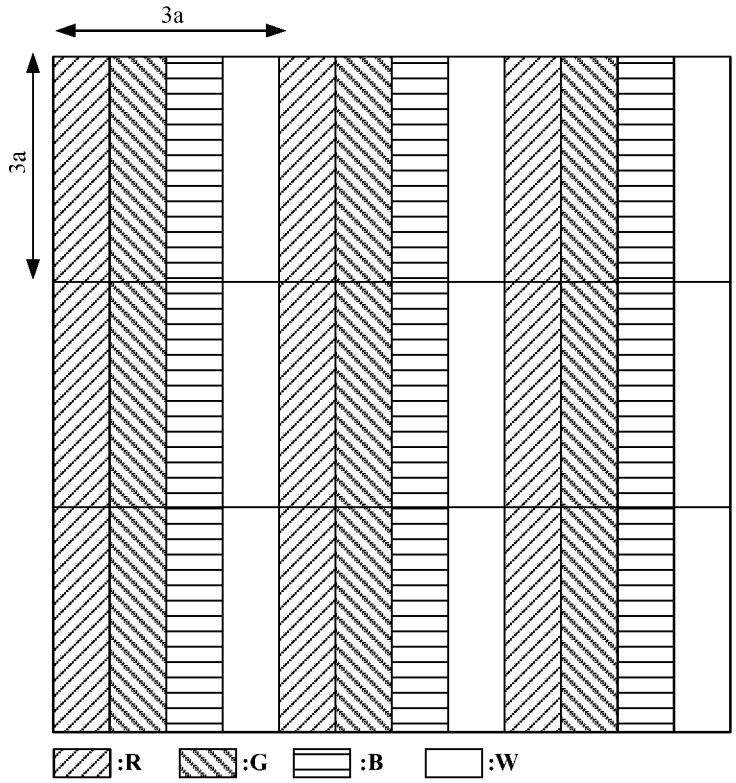
Fig. 2 (Prior Art)
FIG. 2 is a schematic diagram of a pixel matrix in a standard RGBW display panel in the conventional art.

Exemplary embodiments will now be described more fully with reference to the drawings. The exemplary embodiments, however, may be implemented in various forms, and should not be construed as been limited to the implementations set forth herein; instead, the implementations are provided such that the present disclosure will be through and complete, and will fully convey the concept of exemplary embodiments to those skilled in the art. In the drawings, shapes and sizes are exaggerated, deformed or simplified for clarity. In the drawings, like reference symbols indicate similar or same structures, and thus their detailed description will be omitted.

In addition, the described features, structures or steps may be combined in one or more embodiments in any suitable ways. In the following description, many detailed details are provided to provide a full understanding of the embodiments of the present disclosure. However, those skilled in the art would realize that the embodiments of the present disclosure may be implemented without one or more of the detailed details, or other methods, steps, structures, and the like may be applied.

Firstly, the present exemplary embodiment provides a display panel, and the display panel may be a liquid crystal display panel or an OLED display panel. In other exemplary embodiments of the present disclosure, the display panel may also be other flat display panel such as a PLED (Polymer Light-Emitting Diode) display panel, a PDP (Plasma Display Panel) display panel. That is, in the present example implementation, the applicable range is not particularly limited.

Figure 3:
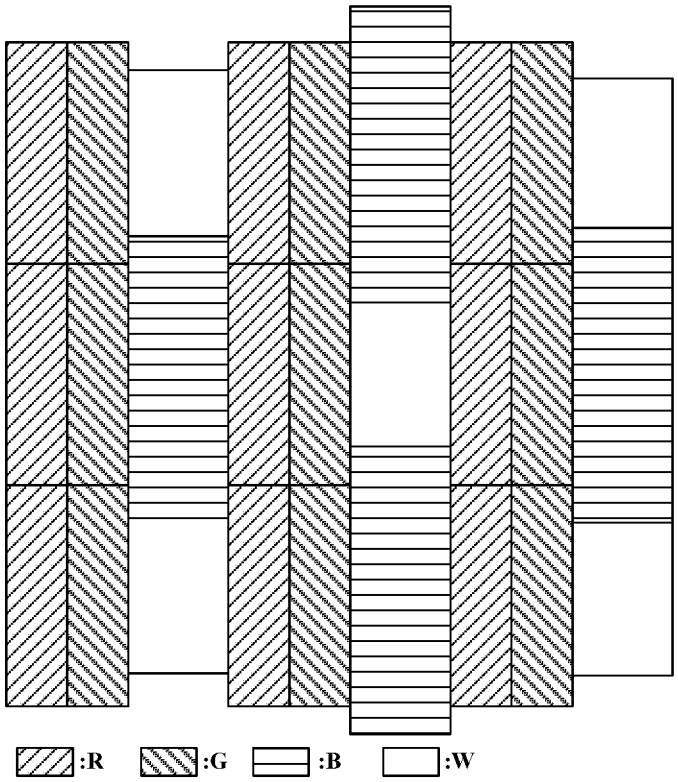
Fig. 3 (Prior Art)
FIG. 3 is a schematic diagram of a pixel matrix in a RGBW display panel.

FIG. 3 is a schematic diagram of a pixel matrix of a SPR-WRGB display panel. As can be seen, in FIG. 3, numbers and arrangements of red sub pixels and green sub pixels are the same with those in a standard RGB display panel, while widths of the red sub pixels and green sub pixels are slightly contracted. Widths of the blue sub pixels are increased, and a number thereof is reduced to one half of that in a standard RGB display panel. That is, areas of the blue sub pixels are increased to ensure consistency of macroscopic area of pixel units. White sub pixels are arranged in the surplus positions of the blue sub pixel column. The white sub pixels have the same pixel number with the blue sub pixel and smaller area than the blue sub pixel. Such a design of white sub pixels may partially increase the transmittance. However, in this display panel, color rendering is mainly performed by limited sharing of blue sub pixels and white sub pixels in a transverse direction, and there is still pending an improvement in overall rendering effect.

Figure 4:
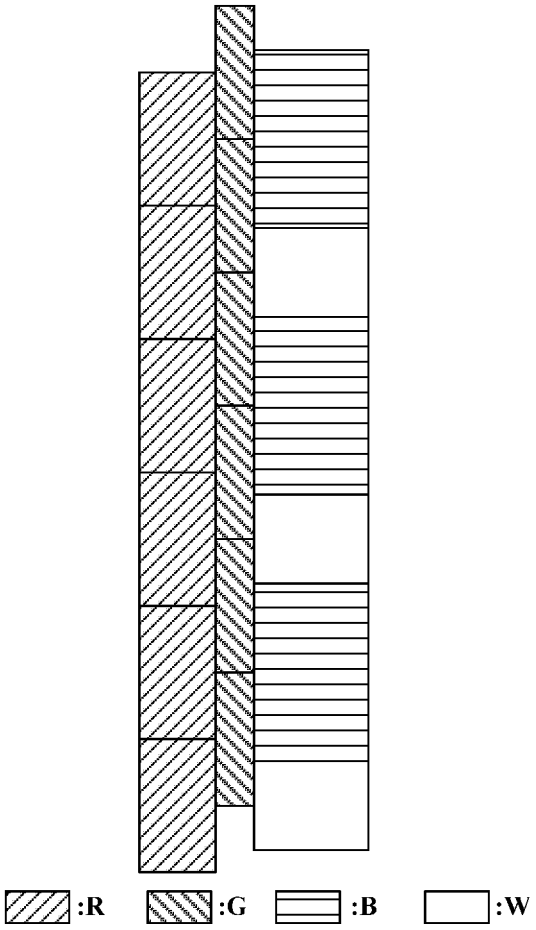
FIG. 4 is a schematic diagram of a pixel matrix structure in an exemplary embodiment of the present disclosure.
Figure 5:
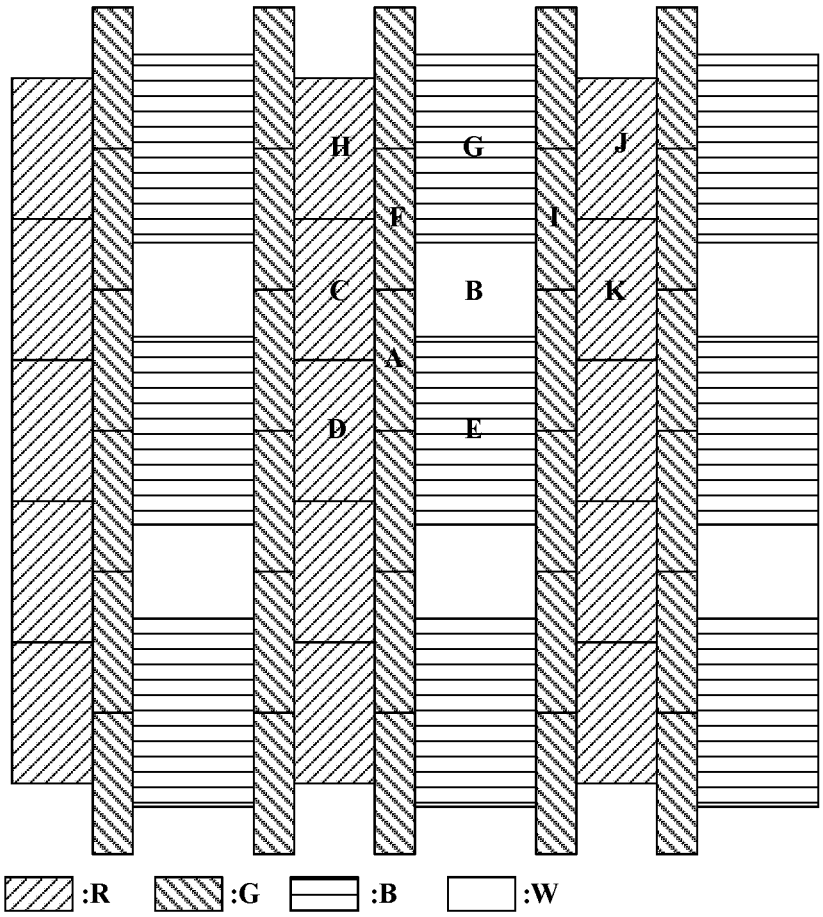
FIG. 5 is a schematic diagram of a pixel matrix structure in an exemplary embodiment of the present disclosure.

A display panel of the example implementation of the present disclosure includes a pixel array including criss-crossed sub pixel rows and sub pixel columns. Herein, the sub pixel columns include a plurality of parallel sub pixel columns, and the parallel sub pixel columns at least include a first sub pixel column, a second sub pixel column and a third sub pixel column that are sequentially arranged as illustrated in FIG. 4 (in the present example implementation, a sequential arrangement may include arrangement in a forward order or arrangement in a backward order). Herein, the first sub pixel column is formed of 2N first color sub pixel, wherein N is a positive integer, the second sub pixel column is formed of 2N second color sub pixels and is offset by a predetermined pitch in a column direction with respect to the first sub pixel column, and the third sub pixel column is formed of alternate N third color sub pixels and N white sub pixels. For example, in FIG. 4, the first sub pixel column is formed of 6 first color sub pixels, the second sub pixel column is formed 6 second color sub pixels and is offset with respect to the first sub pixel column in a column direction, and the third sub pixel column is formed of alternate 3 third color sub pixels and 3 white sub pixels. Referring to FIG. 5, in the present example implementation, the display panel is formed of a plurality of sets of the above first sub pixel column, the second sub pixel column and the third sub pixel column. However, in other exemplary embodiments of the present disclosure, the display panel may further include sub pixel columns arranged in other manners and the like while including one or more sets of the above first sub pixel column, second sub pixel column and third sub pixel column, which are also involved in the protection of the present disclosure.

In order to realize a hybrid color display, in the present example implementation, the first color is red, the second color is green and the third color is blue. However, those skilled in the art would easily appreciate that in other exemplary embodiments of the present disclosure, the first to third colors may also be other color combinations, which is not limited to those in the present exemplary embodiment.

Figure 6:
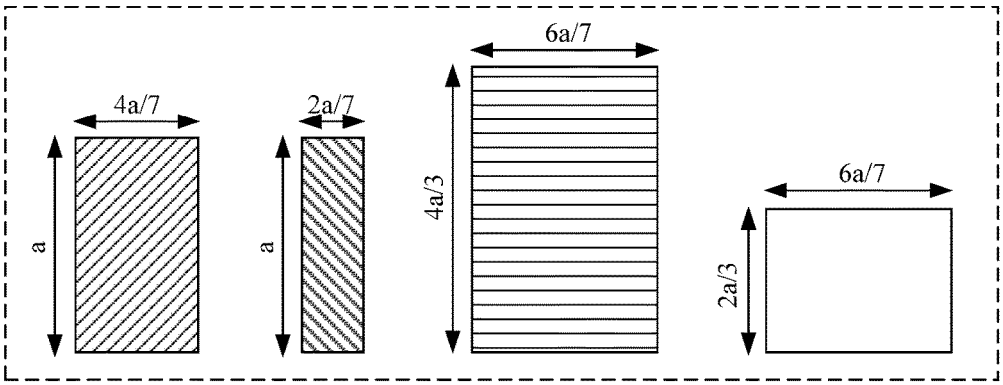
FIG. 6 is a schematic diagram showing a size of each sub pixel in an exemplary embodiment of the present disclosure.
Figure 7:
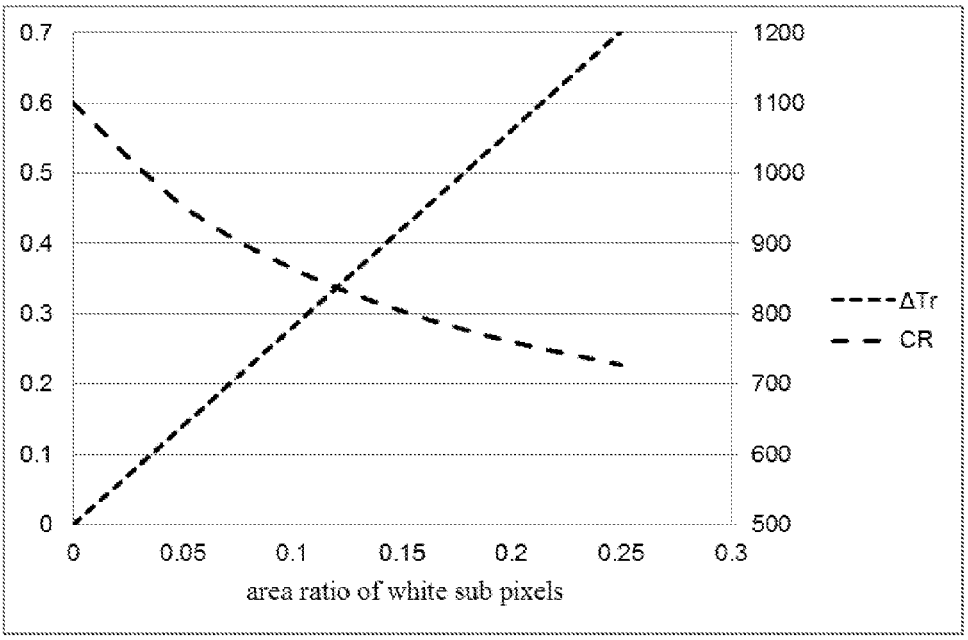
FIG. 7 is a schematic diagram of the relation between the area ratio of the white sub pixels and the transmittance and contrast ratio in an exemplary embodiment of the present disclosure.

Referring to FIGS. 5 and 6, in the present example implementation, the first color sub pixel has an aspect ratio of 7:4, the second color sub pixel has an aspect ratio of 7:2, the third color sub pixel has an aspect ratio of 14:9, the white color sub pixel has an aspect ratio of 7:9, and a longitudinal direction of each sub pixel is the same with the sub pixel column direction, so that each pixel unit has substantially the same visual display profile with the visual display profile of the pixel unit in a standard RGB display panel, thus facilitating providing a required brightness in the subsequent sub pixel rendering algorithms. The width ratio of the first color sub pixel, the second color sub pixel, the third color sub pixel and the white color sub pixel have a is 2:1:3:3. With the above aspect ratio, a total area of all the second color sub pixels, a total area of all the third color sub pixels, a total area of all the white color sub pixels and a macroscopic total area of the first color sub pixels are identical. In addition, a simulation of corresponding relation between the area ratio of white sub pixels and the transmittance and contrast ratio is illustrated in FIG. 7. In order to increase transmittance ($\Delta Tr$) while considering contrast ratio (Cr), in the present example implementation, the total area of all the white sub pixels occupies is less than 15% of the total area of all the sub pixels. At this time, the display panel has transmittance higher than that of a conventional standard RGB display panel by about 40%. Herein, the transmittance $\Delta Tr \approx 2.81x$, wherein x is a percentage of the total area of the white sub pixels in the total area of all the sub pixels, and 2.84 is derived from a real measurement that a standard RGBW display panel has transmittance higher than that of a stander RGB display panel by 70%. Of course, those skilled in the art may particularly adjust area and aspect ratio of each sub pixel according to requirements, and no particular limitation on this is made by the present exemplary embodiment.

In the column direction, the first color sub pixel has the same sub pixel pitch (central distance) with that of the second color sub pixel. For example, as illustrated in FIG. 5, in the present example implementation, the first color sub pixel and the second color sub pixel both has a same sub pixel pitch of a. The predetermined pitch by which the second sub pixel column offsets along the column direction with respect to the first sub pixel column may be a/2, i.e., 1/2 of the sub pixel pitch. Nevertheless, those skilled in the art would easily appreciate that the predetermined pitch may also be 1/5 of the sub pixel pitch, 1/3 of the sub pixel pitch, 3/4 of the sub pixel pitch or any other pitch that are not zero (0). Continuing referring to FIG. 5, in the present exemplary embodiment, display may be performed using a pixel unit together formed of each of the second color sub pixels with its adjacent one white sub pixel, one third color sub pixel and two first color sub pixels. For example, five sub pixels A, B, C, D, and E together form a first pixel unit, five sub pixels B, C, F, C, and H together form a second pixel unit, and five sub pixels B, (I, J, and K together form a third pixel unit. Herein, the first pixel unit and the second pixel unit share the sub pixel B and the sub pixel C, the first pixel unit and the third pixel unit share the sub pixel B, and the second pixel unit and the third pixel unit share the sub pixel B and the sub pixel G.

Figure 8:
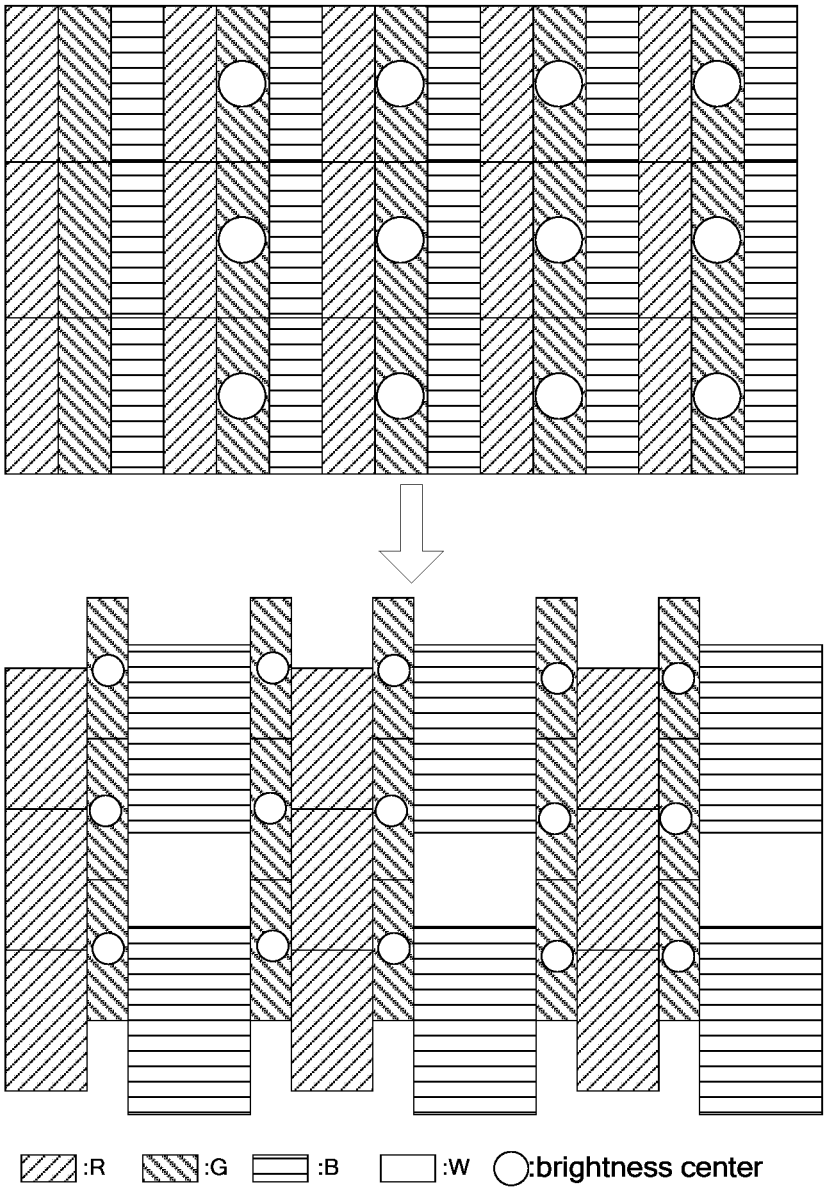
FIG. 8 is a schematic diagram of brightness centers of a standard RGB pixel matrix and a pixel matrix in an exemplary embodiment of the present disclosure.

In the display method of the present exemplary embodiment, the green sub pixel may be used as a brightness center of the pixel unit. When the predetermined offset pitch is 1/2 of sub pixel pitch, the brightness center may be ensured in the central point of the pixel unit. The brightness center is a bright center of the pixel unit, and human eyes have the strongest sensation to the brightness center. It can be used to visually distinguish pixel units, and the resolution of the display panel is usually defined by calculating numbers of the brightness centers. As illustrated in FIG. 8, in the present exemplary embodiment, the number of brightness centers is not reduced in comparison with a conventional standard RGB display device, accordingly, with the same size, it may visually include pixel units having substantially the same number with a standard RGB display device, i.e., visually having substantially the same PPI (pixels per inch) with a standard RGB display device.

In the present example implementation, the display panel is also provided thereon with gate lines providing scan signals to each row of sub pixels and data lines providing data signals to each column of sub pixels. In the present example implementation, the n-th sub pixels in the first to three sub pixel columns are connected to a same gate line, wherein n is a positive integer, to match the above shape and arrangement of each sub pixel and subsequent SPR algorithms. In the present example implementation, similar to the prior art, data lines may be provided between adjacent sub pixel columns, and repeated description thereof will be omitted. Furthermore, brightness distribution will be performed subsequently by a sub pixel rendering method, and thus a light shielding matrix between adjacent first color sub pixels in the first sub pixel column may not be required, thereby lowering the requirement on the manufacturing process. According to an exemplary embodiment of the present disclosure, no shielding matrix is provided between adjacent first color sub pixels in the first sub pixel column.

Further, the present example implementation further provides a display device including the above display panel as well as other components in the prior art such as a gate driver, a source driver, and the like. Display brightness of each sub pixel in the above display panel may be determined by sub pixel rendering (SPR) algorithms. In the present exemplary embodiment, the display device may further include a sub pixel rendering module capable of converting a brightness value of each sub pixel in a first virtual pixel array corresponding to an image to be displayed into a brightness value of each sub pixel in the pixel array according to a sub pixel rendering algorithm.

Figure 9:
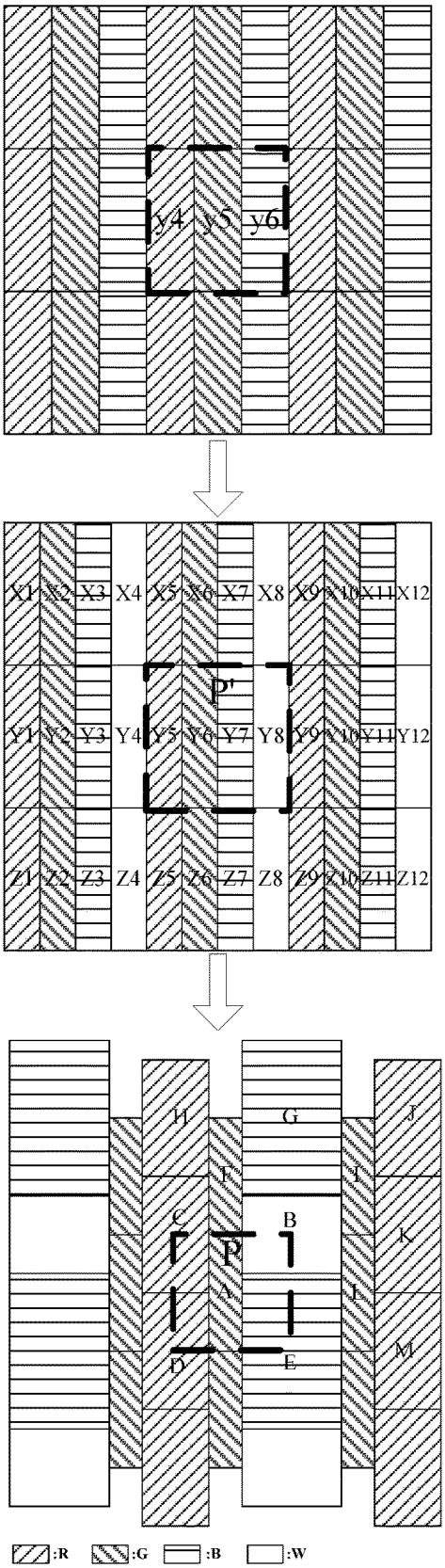
FIG. 9 is a schematic diagram of a sub pixel rendering process in an exemplary embodiment of the present disclosure.

Referring to FIG. 9, in the present exemplary embodiment, the first virtual pixel array may include first virtual pixel units distributed in an array and formed of color sub pixels of red, green and blue, i.e., a standard RGB pixel matrix corresponding to the data information of the image to be displayed. As the pixel array according to the present exemplary embodiment further includes white sub pixels, a second virtual pixel array may be further provided to facilitate the transition of the brightness conversion. The second virtual pixel array includes second virtual pixel units distributed in an array and formed of white sub pixels and color sub pixels of red, green and blue, and may be the RGBW pixel matrix as described above. As illustrated in FIG. 9, firstly, the sub pixel rendering module may correspondingly convert the brightness values of the sub pixels in each first virtual pixel unit into the brightness values of the sub pixels in each second virtual pixel unit; and subsequently, may convert the brightness values of the sub pixels in each second virtual pixel unit into brightness values of the sub pixels in the pixel unit. It should be noted that, if the above first virtual pixel matrix is a RGBW pixel matrix, it is unnecessary to provide the second virtual pixel matrix.

In the present exemplary embodiment, the process of correspondingly converting the brightness values of the sub pixels in each first virtual pixel unit into the brightness values of the sub pixels in each second virtual pixel unit may include the following steps:

S1. extracting a white brightness value from a brightness value of anyone of the first virtual pixel unit, taking the first virtual pixel unit composed of sub pixels y4, y5 and y6 as an example, the white brightness value being:

$$w = k \cdot \min(y4, y5, y6),$$

wherein k is a preset coefficient, and y4, y5 and y6 are brightness values of sub pixels y4, y5 and y6;

S2. subtracting a part contributed by the sub pixel in the white brightness value from the brightness values of each of the sub pixels in the first virtual pixel unit, and obtaining the red brightness value, the green brightness value and the blue brightness value, e.g., the brightness values after subtracting the white brightness value w from y4, y5 and y6 are: y4-w, y5-w and y6-w;

S3. mapping the white brightness value, the red brightness value, the green brightness value and the blue brightness value into brightness values of each of the sub pixels in the second virtual pixel unit, e.g., the obtained brightness values Y5, Y6, Y7 and Y8 of the sub pixels Y5, Y6, Y7 and Y8 in the second virtual pixel unit respectively are:

$$Y5 = \alpha \cdot (y4 - w)$$

$$Y6 = \alpha \cdot (y5 - w)$$

$$Y7 = \alpha \cdot (y6 - w)$$

$$Y8 = w$$

wherein $\alpha$ is a nonlinear conversion factor.

Continuing referring to FIG. 9, wherein in the pixel matrix provided in the present example implementation (at the very bottom of FIG. 9), each of the first color sub pixels, the third color sub pixels and the white sub pixels are shared by four pixel units. That is, they have to make contributions to the brightness of the sub pixels in the second virtual pixel units, which respectively correspond to the four pixel units having the same color with the sub pixel. Based on this, brightness value of each sub pixel may be obtained by summation. For example, in any one of the above pixel units, any one of the brightness values of the first color sub pixel, the second color sub pixel and the white sub pixel is presented by $L_1$:

$$L_1=p(x_0l_0+x_1l_1+x_2l_2+x_3l_3)$$

wherein $l_0$~$l_3$ and $x_0$~$x_3$ respectively are brightness values of the sub pixels in the second virtual pixel units, which respectively correspond to all of the pixel units sharing the sub pixel, having the same color with the sub pixel and brightness ratios contributed by the sub pixels, and p is an adjustment coefficient and $p\leq 1$. The adjustment coefficient mainly attenuates the calculated brightness value to avoid overflow of the brightness. Meanwhile, the adjustment coefficient p may also adjust the brightness and saturability of the displayed image.

The second color sub pixel is not shared by other pixel units, and in any one of the pixel unit, the second color sub pixel has a brightness value of $L_2=q\cdot n$. Herein, n is a brightness value of the second color sub pixel in the second virtual pixel unit corresponding to the pixel unit, and q is an adjustment coefficient and $q\leq 1$. The adjustment coefficient mainly attenuates the calculated brightness value to avoid overflow of the brightness. Meanwhile, the adjustment coefficient q may also be used to adjust the brightness and contrast ratio of the displayed image.

Continuing referring to FIG. 9, one pixel unit includes two first color sub pixels, and thus in the second virtual pixel unit, the brightness of the first color sub pixel is provided by both of the first color sub pixel in the pixel matrix. Accordingly, in the present exemplary embodiment, while calculating the brightness value of the first sub pixel, the brightness ratio is 1/2, and while calculating the brightness values of the third color sub pixel and the white sub pixel, the brightness ratio is 1.

Taking the pixel unit P constituted by A, B, C, D and E in FIG. 9 as an example, its corresponding second virtual pixel unit P' is constituted by sub pixels Y5, Y6, Y7 and Y8. Herein, the white sub pixel B is shared by the pixel unit P and the upper pixel unit (B, C, F, G and H), the upper right pixel unit (B, G, I, J and K) and the right pixel unit (B, E, K, L and M), and the corresponding second virtual pixel unit thereof are the second virtual pixel unit P' and the upper second virtual pixel unit (X5, X6, X7 and X8), the upper right second virtual pixel unit (X9, X10, X11 and X12) and the right second virtual pixel unit (Y9, Y10, Y11 and Y12), respectively. That is, the white sub pixel B is required to provide all the brightness of the white sub pixels X8, Y8, X12 and Y12 in the second virtual pixel matrix. Therefore, the brightness value B of the white sub pixel B may be:

$$B=p(X8+Y8+X12+Y12)$$

The red sub pixel C in the pixel matrix is shared by red sub pixels X1, X5, Y1 and Y5 in the second virtual pixel matrix. Similarly, the brightness value C thereof may be:

$$C=p(1/2\cdot X1+1/2\cdot X5+1/2\cdot Y1+1/2\cdot Y5)$$

The red sub pixel D in the pixel matrix is shared by red sub pixels Y1, Y5, Z1 and Z5 in the second virtual pixel matrix. Similarly, the brightness value D thereof may be:

$$D=p(1/2\cdot Y1+1/2\cdot Y5+1/2\cdot Z1+1/2\cdot Z5)$$

The blue sub pixel E in the pixel matrix is shared by blue sub pixels Y7, Y11, Z7 and Z11 in the second virtual pixel matrix. Similarly, the brightness value E thereof may be:

$$E=p(Y7+Y11+Z7+Z11)$$

The brightness value A of the green sub pixel A in the pixel matrix may be:

$$A=q\cdot Y6$$

Herein, both of the adjustment coefficients p and q are equal to or smaller than 1, and may be set according to actual requirement.

Brightness of each sub pixel in other pixel units in the pixel matrix may be calculated and obtained by the above means, and display may be performed by providing corresponding data signals via a source driver, data lines and the like based on the above calculation. Those skilled in the art would easily appreciate that the above ratios and coefficients involved in the above calculation may also be other values, and are not limited to the present exemplary embodiment.

Furthermore, the present exemplary embodiment further provides a display method corresponding to the above display device. Since the detailed implementation of the method has been described in detail in the exemplary embodiments regarding the above display device, repeated description will be omitted herein.

In the display device and the display method according to the present exemplary embodiment, by providing a new RGBW pixel matrix structure, on one hand, the transmittance of the display panel may be effectively increased, thereby reducing power consumption; meanwhile, white sub pixels are arranged in a dispersed manner, thereby bright bars may be prevented from occurring; and such a pixel matrix structure may uniformly distribute brightness of the pixel unit in each direction, thereby improving overall rendering effects and providing a better view angle. On the other hand, the pixel matrix, combining with corresponding sub pixel rendering algorithms, may visually provide a PPI substantially close to a standard RGB display paned; meanwhile, compared with typical standard RGBW pixel matrix, a number of sub pixels may be greatly reduced and correspondingly reducing the wirings such as data lines, an aperture ratio of the display device may be efficiently increased while reducing the cost and lowering process difficulty, thereby providing a better display effect.

The present disclosure has been described by the above relating embodiments; however, the above embodiments are merely examples of the present disclosure. It should note that, the disclosed embodiments do not limit the scope of the present disclosure. Instead, all the changes and modifications without departing the spirit and scope of the present disclosure belong to the patent protection scope of the present disclosure.

What is claimed is:

1. A display panel comprising at least a first sub pixel column, a second sub pixel column and a third sub pixel column that are sequentially arranged, wherein:

the first sub pixel column is formed of 2N first color sub pixels, where N is a positive integer;

the second sub pixel column is formed of 2N second color sub pixels and is offset by a predetermined pitch in a column direction with respect to the first sub pixel column; and the third sub pixel column is formed of alternate N third color sub pixels and N white sub pixels, wherein each of the second color sub pixels forms a pixel unit together with one white sub pixel, one third color sub pixel and two first color sub pixels adjacent to the second color sub pixel, to perform display;

wherein the first color is red, the second color is green, and the third color is blue; and wherein the first color sub pixel has an aspect ratio of 7:4, the second color sub pixel has an aspect ratio of 7:2, the third color sub pixel has an aspect ratio of 14:9, the white sub pixel has an aspect ratio of 7:9, and a longitudinal direction of each sub pixel is the same as that of a corresponding sub pixel column.

2. The display panel according to claim 1, wherein the second color sub pixel is a brightness center of the pixel unit.

3. The display panel according to claim 1, wherein the predetermined pitch is 1/2 of a sub pixel pitch.

4. The display panel according to claim 1, wherein a total area of all the first color sub pixels, a total area of all the second color sub pixels, and a total area of all the third color sub pixels are identical.

5. The display panel according to claim 1, wherein a total area of all the white sub pixels occupies less than 15% of a total area of all the sub pixels.

6. The display panel according to claim 1, wherein a width ratio among the first color sub pixel, the second color sub pixel, the third color sub pixel and the white color sub pixel is 2:1:3:3.

7. The display panel according to claim 1, wherein n-th sub pixels in the first, second and third sub pixel columns are connected to a same gate line, where n is a positive integer.

8. The display panel according to claim 1, wherein no shielding matrix is provided between adjacent first color sub pixels in the first sub pixel column.

9. The display panel according to claim 1, wherein the display panel is a liquid crystal display panel or an organic light emitting diode display panel.

10. The display device according to claim 1, comprising:

a gate driver;

a source driver; and a display panel.

11. A display method applied in a display panel comprising at least a first sub pixel column, a second sub pixel column and a third sub pixel column that are sequentially arranged, wherein: the first sub pixel column is formed of 2N first color sub pixels, where N is a positive integer; the second sub pixel column is formed of 2N second color sub pixels and is offset by a predetermined pitch in a column direction with respect to the first sub pixel column; and the third sub pixel column is formed of alternate N third color sub pixels and N white sub pixels, wherein each of the second color sub pixels forms a pixel unit together with one white sub pixel, one third color sub pixel and two first color sub pixels adjacent to the second color sub pixel to perform display; wherein the first color is red, the second color is green, and the third color is blue; and wherein the first color sub pixel has an aspect ratio of 7:4, the second color sub pixel has an aspect ratio of 7:2, the third color sub pixel has an aspect ratio of 14:9, the white sub pixel has an aspect ratio of 7:9, and a longitudinal direction of each sub pixel is the same as that of a corresponding sub pixel column, the display method comprising:

according to a sub pixel rendering algorithm, converting a brightness value of each sub pixel in a first virtual pixel array corresponding to an image to be displayed into a brightness value of each sub pixel in the pixel unit.

12. The display method according to claim 11, wherein the first virtual display array comprises first virtual pixel units distributed in array and formed of the first to third color sub pixels, and a second virtual pixel array comprises second virtual pixel units distributed in array and formed of white sub pixels and the first to third color sub pixels, the display method further comprising:

correspondingly converting a brightness value of each of the sub pixels in the first virtual pixel unit into a brightness value of each of the sub pixels in the second virtual pixel unit; and converting a brightness value of each of the sub pixels in the second virtual pixel unit into a brightness value of each sub pixel in the pixel unit.

13. The display method according to claim 12, wherein the correspondingly converting a brightness value of each of the sub pixels in the first virtual pixel unit into a brightness value of each of the sub pixels in the second virtual pixel unit comprises:

extracting a white brightness value from a brightness value of anyone of the first virtual pixel unit;

subtracting the white brightness value from brightness values of each of the sub pixels in the first virtual pixel unit, and obtaining a first to a third color brightness values;

mapping the white brightness value and the first to the third color brightness values into brightness values of each of the sub pixels in the second virtual pixel unit.

14. The display method according to claim 12, wherein the converting a brightness value of each of the sub pixels in the second virtual pixel unit into a brightness value of each sub pixel in the pixel units comprises:

setting brightness values of any one of the first color sub pixels, the third color sub pixels and white sub pixels in any one of the pixel unit as $L_1$ according to the equation:

$$L_1=p(x_0l_0+x_1l_1+x_2l_2+x_3l_3),$$

where $l_0$~$l_3$ respectively are brightness values of the virtual sub pixels in the second virtual pixel units, which respectively correspond to all of the pixel units sharing the sub pixel, the virtual sub pixels having the same color as the shared sub pixel, and $x_0$~$x_3$ respectively are brightness ratios contributed by the virtual sub pixels, and p is an adjustment coefficient and $p \leq 1$; and setting brightness values of any one of the second color sub pixel in any one of the pixel unit as $L_2$ according to the equation $L_2=q \cdot n$, where n is a brightness value of the second color sub pixel in the second virtual pixel unit corresponding to the pixel unit, and q is an adjustment coefficient and $q \leq 1$.

* * * * *